US009260814B2

(12) United States Patent
Seo et al.

(10) Patent No.: US 9,260,814 B2
(45) Date of Patent: Feb. 16, 2016

(54) WASHING MACHINE WITH WEIGHT SENSING UNIT

(71) Applicants: Bosung Seo, Seoul (KR); Myunghun Im, Seoul (KR); Sooyoung Oh, Seoul (KR); Changoh Kim, Seoul (KR)

(72) Inventors: Bosung Seo, Seoul (KR); Myunghun Im, Seoul (KR); Sooyoung Oh, Seoul (KR); Changoh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 605 days.

(21) Appl. No.: 13/671,661

(22) Filed: Nov. 8, 2012

(65) Prior Publication Data

US 2013/0125595 A1 May 23, 2013

(30) Foreign Application Priority Data

Nov. 17, 2011 (KR) ..... 10-2011-0120355

(51) Int. Cl.
*D06F 37/20* (2006.01)
*D06F 39/00* (2006.01)

(52) U.S. Cl.
CPC ..... *D06F 39/003* (2013.01)

(58) Field of Classification Search
CPC ..... D06F 39/003
See application file for complete search history.

(56) References Cited

U.S. PATENT DOCUMENTS

2011/0219551 A1* 9/2011 Im et al. ..... 8/137

FOREIGN PATENT DOCUMENTS

KR 10-2006-31065 A * 4/2006

OTHER PUBLICATIONS

English machine translation of 10-2006-31065A.*

* cited by examiner

*Primary Examiner* — Michael Barr
*Assistant Examiner* — Jason Riggleman
(74) *Attorney, Agent, or Firm* — Dentons US LLP

(57) ABSTRACT

A washing machine having a weight sensing unit comprises a cabinet forming an appearance, a tub disposed within the cabinet, springs installed between the tub and a frame of the cabinet, and a weight sensing unit disposed on the frame of the cabinet, one end of the springs being coupled to the weight sensing unit. The weight sensing unit comprises a case coupled to the frame of the cabinet, a load cell supported with being received in the case, and a pressure distributing member mounted on the load cell to hold the spring thereon.

7 Claims, 7 Drawing Sheets

WASHING MACHINE WITH WEIGHT SENSING UNIT

CROSS-REFERENCE TO RELATED APPLICATION

Pursuant to 35 U.S.C. §119(a), this application claims the benefit of earlier filing date and right of priority to Korean Application No. 10-2011-0120355, filed on Nov. 17, 2011, the contents of which is incorporated by reference herein in its entirety.

BACKGROUND OF THE INVENTION

1. Field of the Invention

This specification relates to a unit for sensing a weight of a target to be washed in a washing machine.

2. Background of the Invention

A washing machine is a device for washing laundry, clothes or the like, and has a rotatable drum within a main body thereof. A target to be washed, such as clothes or the like, is stored within the drum and washing water, detergent and the like are then introduced into the drum so as to wash the target to be washed by a rotational force of a pulsator equipped in the drum.

As one example of such washing machines, a drum type washing machine includes a cabinet forming a receiving space, a tub to receive washing water within the cabinet, a drum rotatably disposed within the tub, and a driving motor to rotate the drum.

Among the drum type washing machines, for a certain type that the target to be washed is introduced through a front surface, the tub having a cylindrical shape whose front side is open is disposed within the cabinet. A plurality of springs, each of which has one end connected to an upper surface of the cabinet and is contractible and expandable up and down, may be connected to an upper surface of the tub. A plurality of dampers for reducing vibration generated in a vertical direction of the tub are disposed below the tub. The driving motor is mounted onto a rear side of the tub.

The drum is a cylindrical body rotatably disposed in the tub and receives the target to be washed therein. The driving motor provides a driving force for rotating the drum. The drum is rotated by a rotational force transferred from the driving motor.

In the meantime, the drum type washing machine rotates the driving motor by applying a current to the driving motor in order to sense a weight or an amount of laundry stacked in the drum. Accordingly, a sensor disposed in the driving motor senses a changing level of a rotating speed of the drum, and the sensed value is compared with a previously stored result value, determining the laundry weight.

However, the method of sensing the weight through the driving motor is to merely indirectly determine the weight other than directly measuring it. Consequently, the method has a problem of decreasing accuracy due to various causes, such as positions of the laundry, a characteristic of the driving motor or the like.

Hence, to directly sense the laundry weight within the drum, an approach of sensing the laundry weight by use of a load cell as a weight sensing sensor, which is disposed at a portion contacting a spring installed on the tub, may be used. The load cell which contacts the spring may be transformed due to pressure applied by the spring, and the laundry weight is sensed by electrically sensing a transformed level of the load cell based on strain gages or the like.

However, the case of using the load cell has also a problem of lowering accuracy of sensing the laundry weight, due to a biased transformation of the load cell or the like, which is caused due to non-uniform pressure being applied by the spring, the contact portion between the spring and the load cell being shifted due to vibration generated in response to driving the drum or the like, or the changed posture of the load cell.

SUMMARY OF THE INVENTION

Therefore, to overcome the problems of the related art, an aspect of the detailed description is to provide a washing machine having a weight sensing unit, capable of enhancing accuracy in sensing a laundry weight by allowing pressure applied by a spring to be uniformly transferred to a load cell.

Another aspect of the detailed description is to provide a washing machine having a weight sensing unit, capable of enhancing accuracy in sensing a laundry weight by allowing pressure applied to a load cell to be concentrated on a potion of the load cell to be transformed.

Another aspect of the detailed description is to provide a washing machine having a weight sensing unit, capable of enhancing accuracy in sensing a laundry weight via a load cell by allowing a portion of the load cell, which is to be transformed, to be smoothly transformed with stably securing a posture of the load cell.

Another aspect of the detailed description is to provide a washing machine having a weight sensing unit, capable of enhancing accuracy in sensing a laundry weight via a load cell by preventing a portion of the load cell, which is affected by pressure transferred from a spring, from being changed even if a position or posture of the spring changes due to vibration or the like.

Another aspect of the detailed description is to provide a method for sensing a laundry weight in a washing machine, capable of sensing a more accurate laundry weight by simultaneously performing direct sensing of a laundry weight via a load cell, which directly senses the laundry weight within a drum, and indirect sensing of the laundry weight by using a driving motor, which indirectly senses the laundry weight within the drum, and compensating for the sensed values.

To achieve these and other advantages and in accordance with the purpose of this specification, as embodied and broadly described herein, there is provided a washing machine having a weight sensing unit comprising a cabinet forming an appearance, a tub disposed within the cabinet, at least one spring installed between the tub and a frame of the cabinet, and a weight sensing unit disposed on the frame of the cabinet, one end of the springs being coupled to the weight sensing unit. Here, the weight sensing unit may comprise a case coupled to the frame of the cabinet, a load cell supported with being received in the case, and a pressure distributing member mounted on the load cell, the pressure distributing member holding one end of the spring thereon.

The pressure distributing member may comprise a holding recess on which the one end of the spring is held, and the holding recess may implement a point contact with the one end of the spring. The holding recess may have a curved surface recessed to have a predetermined curvature, and the one end of the spring may have a circular section with a predetermined curvature. Here, the curvature of the curved surface of the holding recess may be greater than the curvature of the section of the one end of the spring.

The holding recess may have a curved surface recessed to have a predetermined curvature. Here, an extension line formed by the lowest points of the curved surface may form a curved line, which is convex with a predetermined curvature in an orthogonal direction to a direction that the curvature of the curved surface is formed.

This configuration may allow the spring to contact the holding recess at one point even if the position or posture of the spring changes due to vibration or the like, thereby preventing the change in a portion of the load cell to which pressure is applied. Consequently, pressure by a point contact may be evenly applied only to a specific portion of the load cell by virtue of the pressure distributing member, enhancing accuracy in sensing a laundry weight via the load cell.

The pressure distributing member may further comprise a surface contact portion mounted onto the load cell to have a surface contact with the load cell. At least one side of the load cell may be formed in an arcuate shape and comprise a mounting portion on which the pressure distributing member is mounted. The mounting portion may be formed on an arcuate peak of the load cell.

The configuration may allow generation of a surface contact such that pressure applied from the spring can be uniformly transferred to the mounting portion of the load cell by virtue of the pressure distributing member. Also, the surface contact portion may be concentrated on the central portion of the load cell which is a portion to be transformed, enhancing accuracy in the sensing of the laundry weight.

The case may comprise a receiving portion for receiving the load cell therein, and side walls forming side surfaces of the receiving portion. The load cell may be supported between the side walls with being received in the receiving portion.

Here, an interval between the side walls may change along the load cell, and an interval between the side walls at both ends of the load cell may be narrower than an interval between the side walls at a central portion of the load cell.

Accordingly, the side walls located at the both ends of the load cell may stably secure the load cell but not secure the central portion of the load cell to be transformed. This may allow a smooth transformation of the portion to be transformed with stably securing the posture of the load cell, resulting in enhancing accuracy in sensing the laundry weight via the load cell.

The case may further comprise coupling portions each having a coupling hole coupled to the frame of the cabinet by use of a screw.

To achieve these and other advantages and in accordance with the purpose of this specification, as embodied and broadly described herein, there is provided a method for sensing a weight in a washing machine, in sensing a laundry weight using a load cell, the method comprising saving an initial value sensed via the load cell at the moment of an initial installation of the washing machine, sensing the laundry weight via the load cell after the laundry is put into a drum, activating a driving motor for driving the drum and sensing the laundry weight by measuring a rotating speed of the driving motor via a sensor equipped in the driving motor, and compensating for the laundry weight sensed via the load cell to the laundry weight sensed by using the driving motor or the laundry weight sensed by using the driving motor to the laundry weight sensed via the load cell.

The compensating for the laundry weight may be performed to decide the laundry weight by giving a preset weight to each of the laundry weight sensed via the load cell and the laundry weight sensed by using the driving motor.

The configuration may allow simultaneous operations of the laundry weight sensing using a load cell for directly sensing the weight of the laundry within the drum and the laundry weight sensing using the driving motor for indirectly sensing the weight of the laundry within the drum, and compensation for those sensed values, resulting in more accurate sensing of the laundry weight.

The configuration according to the present disclosure may provide the following effects.

The present disclosure may implement a surface contact such that pressure applied from a spring can be uniformly transferred to a load cell, and allow the surface contact portion to be concentrated on a portion of the load cell, which is to be transformed. This may result in enhancing accuracy in sensing a laundry weight via the load cell.

The smooth transformation of a portion of the load cell to be transformed may be enabled with stably securing the posture of the load cell, enhancing accuracy in sensing a laundry weight via the load cell.

A change in a portion, which is affected by pressure applied to the load cell, may be prevented even if a position or posture of a spring is changed due to vibration or the like, enhancing accuracy in sensing a laundry weight via the load cell.

The sensing of a laundry weight via the load cell that the laundry weight within a drum is directly sensed and the sensing of a laundry weight via a driving motor that the laundry weight within the drum is indirectly sensed may be performed simultaneously, and those obtained values may be compensated for, resulting in allowing more accurate measurement of the laundry weight.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings.

For the sake of brief description with reference to the drawings, the same or equivalent components will be provided with the same reference numbers, and description thereof will not be repeated.

Figure 1:
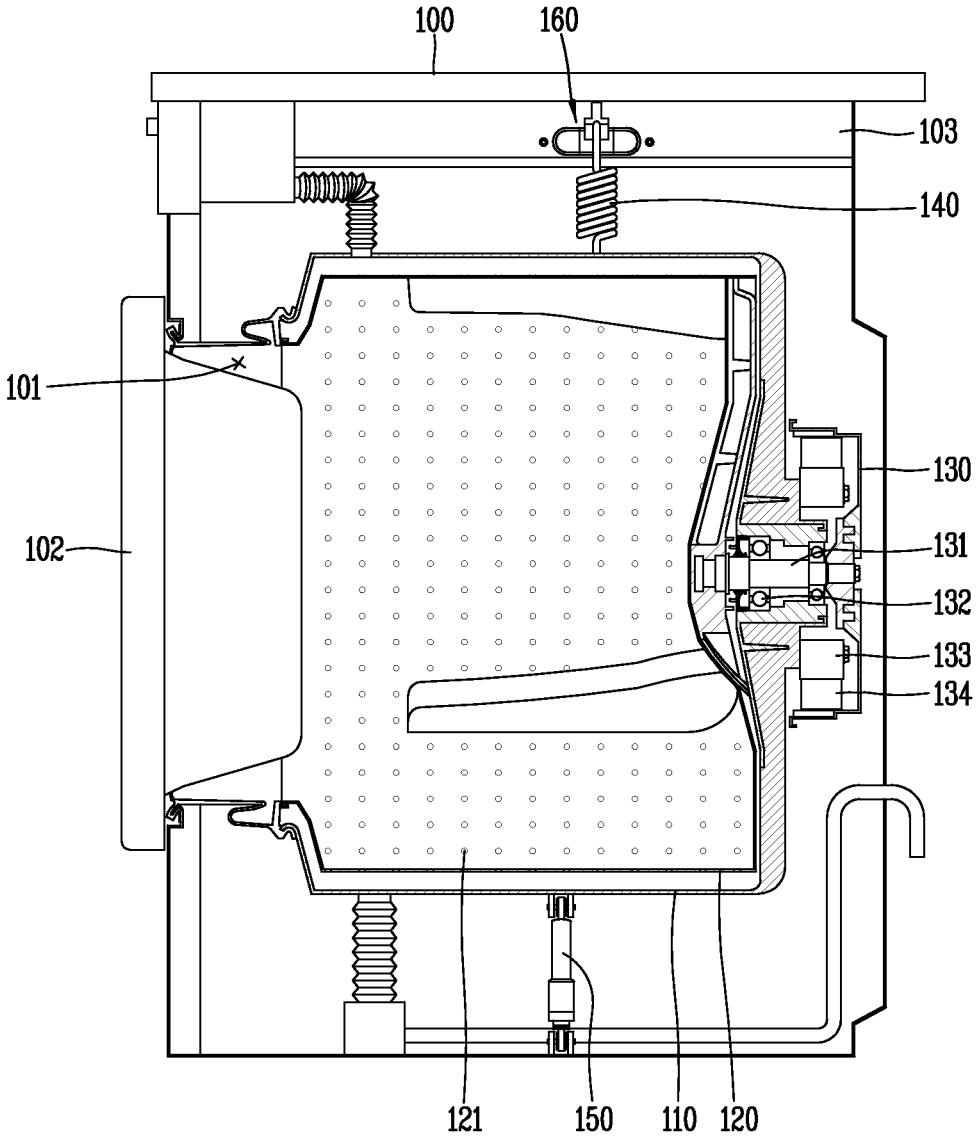
FIG. 1 is a side sectional view of a washing machine in accordance with one exemplary embodiment.

FIG. 1 is a side sectional view of a washing machine in accordance with one exemplary embodiment. As shown in FIG. 1, a washing machine according to one exemplary embodiment may include a cabinet 100 defining an appearance and forming a receiving space therein, a tub 110 disposed within the cabinet 100 in a back-and-forth direction to store washing water therein, a drum 120 rotatably disposed within the tub 110, and a driving motor 130 to rotate the drum 120.

An opening 101 through which laundry is introduced or taken away, may be formed at a front surface of the cabinet 100, and a door 102 for opening or closing the opening 101 may be disposed at an adjacent position of the opening 101.

The tub 110 which has a cylindrical shape having an open front may be disposed within the cabinet 100. A plurality of springs 140 which are contractible and expandable up and down may have one end connected to an upper surface of the cabinet 100 and the other end connected to an upper surface of the tub 110. Here, FIG. 1 shows only one spring, but it is merely illustrative. The spring may be provided in plurality.

A plurality of dampers 150 for reducing vibration generated in a vertical direction of the tub 110 may be disposed below the tub 110. Here, FIG. 1 shows only one damper, but it is merely illustrative. The damper may be provided in plurality. The driving motor 130 may be mounted onto a rear surface of the tub 110.

The drum 120 may have a cylindrical body rotatably disposed within the tub 110, and accommodate laundry therein. A plurality of drain holes 121 may be formed through an outer circumferential surface of the drum 120. Accordingly, the laundry may be rotated with being sunk in the washing water contained in the tub 110.

The driving motor 130 may apply a driving force for rotating the drum 120. The driving motor 130 may be coupled to the rear surface of the tub 110. A rotational shaft 131 may be coupled to the drum 120 to transfer the rotational force of the driving motor 130. A bearing 132 may rotatably support the rotational shaft 131. Here, the driving motor 130 may include a stator 133 and a rotor 134, and the rotational shaft 131 may be press-fit into the rotor 134.

Figure 2:
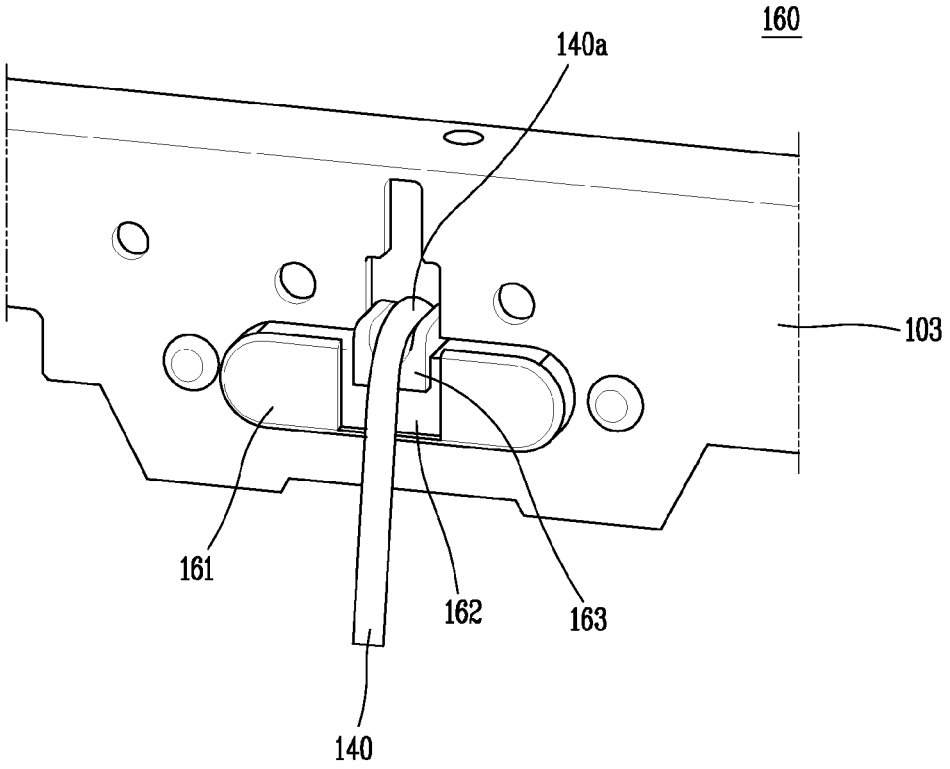
FIG. 2 is a schematic view of a weight sensing unit.

FIG. 2 is a schematic view of a weight sensing unit. As shown in FIG. 2, one end 140*a* of the spring 140 may be hung on a weight sensing unit 160 to be coupled to a frame 103 of the cabinet 100. That is, the spring 140 may be installed between the tub 110 and the frame 103 of the cabinet 100.

The weight sensing unit 160 may be mounted onto the frame 103 of the cabinet 100 to which the one end of the spring 140 is coupled. Referring to FIG. 2, the weight sensing unit 160 may include a case 161 coupled to the frame 103 of the cabinet 100, a load cell 162 supported with being accommodated within the case 161, and a pressure distributing member 163 mounted onto the road cell 162 and having one end of the spring held thereover.

Figure 3:
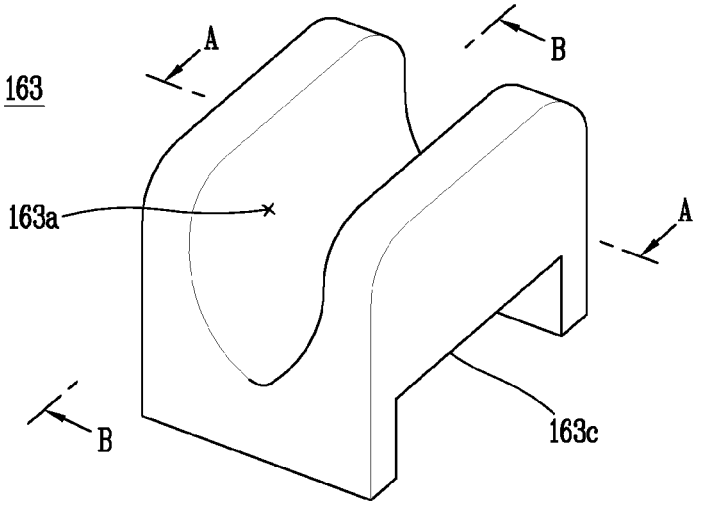
FIG. 3 is a perspective view of a pressure distributing member.

FIG. 3 is a perspective view of the pressure distributing member 163. As shown in FIG. 3, the pressure distributing member 163 may correspond to a portion where the weight sensing unit 160 contact the one end 140*a* of the spring 140. Therefore, the pressure distributing member 163 may include a holding recess 163*a* recessed to hold the one end 140*a* of the spring 140 in a contact state.

Figure 4:
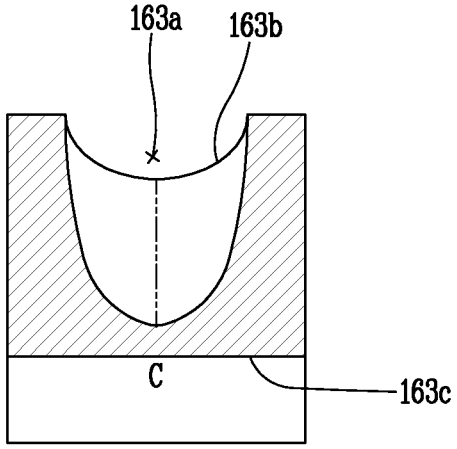
FIG. 4 is a sectional view of the pressure distributing member taken along the line A-A of FIG. 3.
Figure 5:
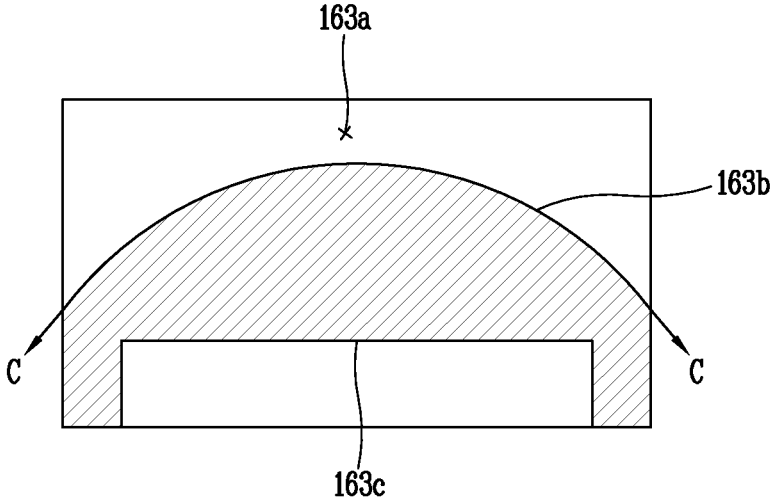
FIG. 5 is a sectional view of the pressure distributing member taken along the line B-B of FIG. B.

Here, the contact between the holding recess 163*a* and the one end 140*a* of the spring 140 at one position may be allowed by a curved surface which forms an inside of the holding recess 163*a* as shown in FIGS. 4 and 5.

FIG. 4 is a sectional view of the pressure distributing member taken along the line A-A of FIG. 3. As shown in FIG. 4, the holding recess 163*a* may have a curved surface 163*b* which is recessed to have a predetermined curvature. Here, the one end 140*a* of the spring 140 may have a circular section. The predetermined curvature may be smaller than a curvature of the section of the spring 140. Accordingly, the one end 140*a* of the spring 140 may contact the curved surface 163*b* at one point.

In the meantime, FIG. 5 is a sectional view of the pressure distributing member taken along the line B-B of FIG. 3. As shown in FIG. 5, an extension line C-C formed by the lowest points of the curved surface 163*b* may define a curved line, which is convex with a predetermined curvature in a direction orthogonal to the direction that the curvature of the curved surface 163*b* is formed. That is, the extension line C-C formed by the lowest points of the curved surface 163*b* may also be formed as a curved line to have a curvature. Accordingly, the one end 140*a* of the spring 140 may contact the extension line C-C formed by the lowest points of the curved surface 163*b* in a lengthwise direction at one point.

Referring to FIGS. 4 and 5, the one end 140*a* of the spring 140 may contact the pressure distributing member 163 at the single point. Here, even if the position or posture of the spring changes due to vibration generated by rotation of the drum, the one end of the spring may contact the pressure distributing member at the single point. This is allowed by virtue of the shape of the curved surface of the holding recess having the different curvatures in the two directions.

This configuration may allow the spring to contact the holding recess at one point even if the position or posture of the spring changes due to the vibration, thereby preventing the change in a portion of the load cell to which pressure is applied. Consequently, pressure by a point contact may be evenly applied only to a specific portion of the load cell by virtue of the pressure distributing member, enhancing accuracy in sensing a laundry weight via the load cell.

Meanwhile, the pressure distributing member 163 may further comprise a surface contact portion 163*c* which is mounted onto the load cell 162 to achieve a surface contact with the load cell 162. The surface contact portion 163*c* may have both ends extending in a longitudinal direction to contact side walls of the load cell 162, and a central part extending in a horizontal direction in correspondence with a mounting portion 162*a* of the load cell 162, which will be explained later. The surface contact portion 163*c* may thus contact the surface of the load cell 162 to stably secure the pressure distributing member 163 onto the load cell 162. Accordingly, the pressure applied to the holding recess 163*a* by the point contact with the spring may be evenly transferred to the mounting portion 162*a* of the load cell 162 in a distributing manner by the surface contact.

Figure 6:
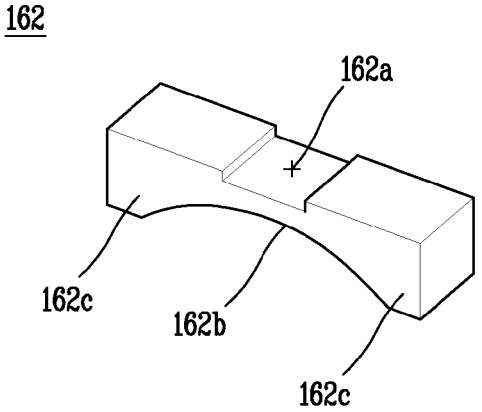
FIG. 6 is a perspective view of a load cell.

FIG. 6 shows the load cell. As shown in FIG. 6, the load cell 162 may have an arcuate shape. More precisely, a surface of a central portion 162*b*, the surface facing the case 161 downwardly, may be concave. The load cell 162 may have a mounting portion 162*a* thereon for mounting of the pressure distributing member 163. The mounting portion 162*a* may be formed on an arcuate peak of the load cell 162.

The configuration may allow generation of a surface contact such that pressure applied from the spring can be uniformly transferred to the mounting portion of the load cell by virtue of the pressure distributing member. Also, the surface contact portion may be concentrated on the central portion of the load cell which is a portion to be transformed, enhancing accuracy in the sensing of the laundry weight. This may result from strain gages (not shown) mounted to a lower side of the central portion 162*b* of the load cell 162 for preventing the transformation of the load cell.

Figure 7:
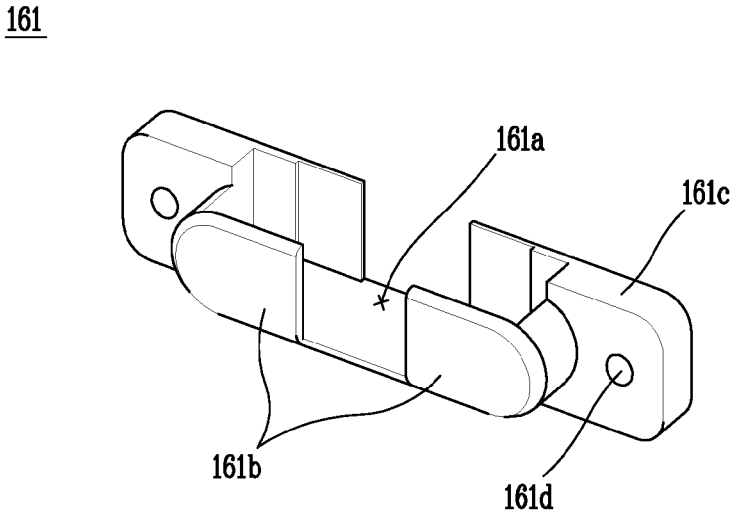
FIG. 7 is a perspective view of a case.

FIG. 7 shows a case of a weight sensing unit. As shown in FIG. 7, the case 161 may include a receiving portion 161*a* for receiving the load cell therein, and side walls 161*b* forming side surfaces of the receiving portion 161*a*. The load cell 162 may be supported between the side walls 161*b* with being received in the receiving portion 161*a*.

Figure 8:
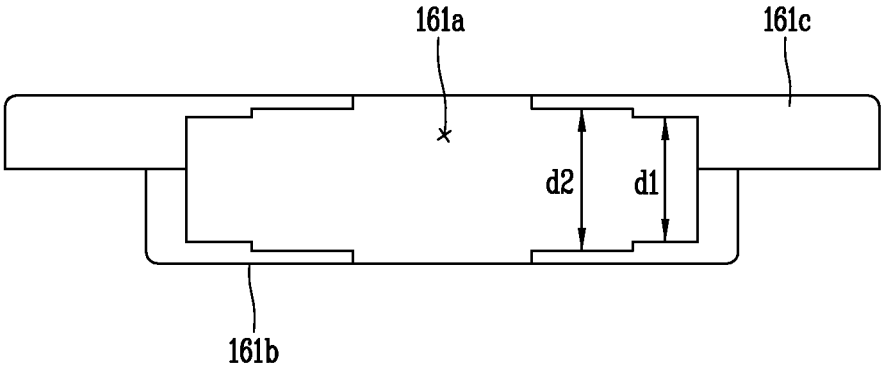
FIG. 8 is a planar view of the case.

FIG. 8 is a planar view of the case. As shown in FIG. 8, an interval between the side walls 161*b* may change in a lengthwise direction of the load cell. That is, an interval d1 between the side walls of both sides 162*c* of the load cell may be narrower than an interval d2 between the side walls at the central portion 162*b* of the load cell.

Figure 9:
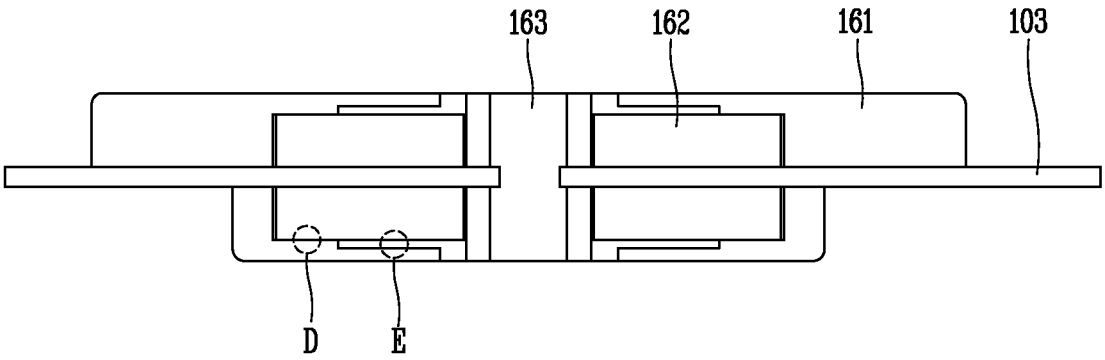
FIG. 9 is a planar view showing the weight sensing unit mounted onto a frame.

FIG. 9 is a planar view showing the load cell mounted onto the case. It may be noticed as shown in FIG. 9 that side surfaces of the both ends 162*c* of the load cell may be closely adhered with the side walls 161*b* (see a circle D). Accordingly, the case may stably secure the load cell. However, it may also be noticed that the portion 162*b* to be transformed in the load cell 162 is spaced apart (see a circle E) from the side walls 161*b* by a predetermined interval. Accordingly, the central portion 162*b* to be transformed in the load cell may not be secured by the case, thereby being smoothly transformed by pressure applied from the spring. That is, the case may stably secure the posture of the load cell with allowing the portion to be transformed to be smoothly transformed, thereby enhancing accuracy in the sensing of the laundry weight via the load cell.

Figure 10:
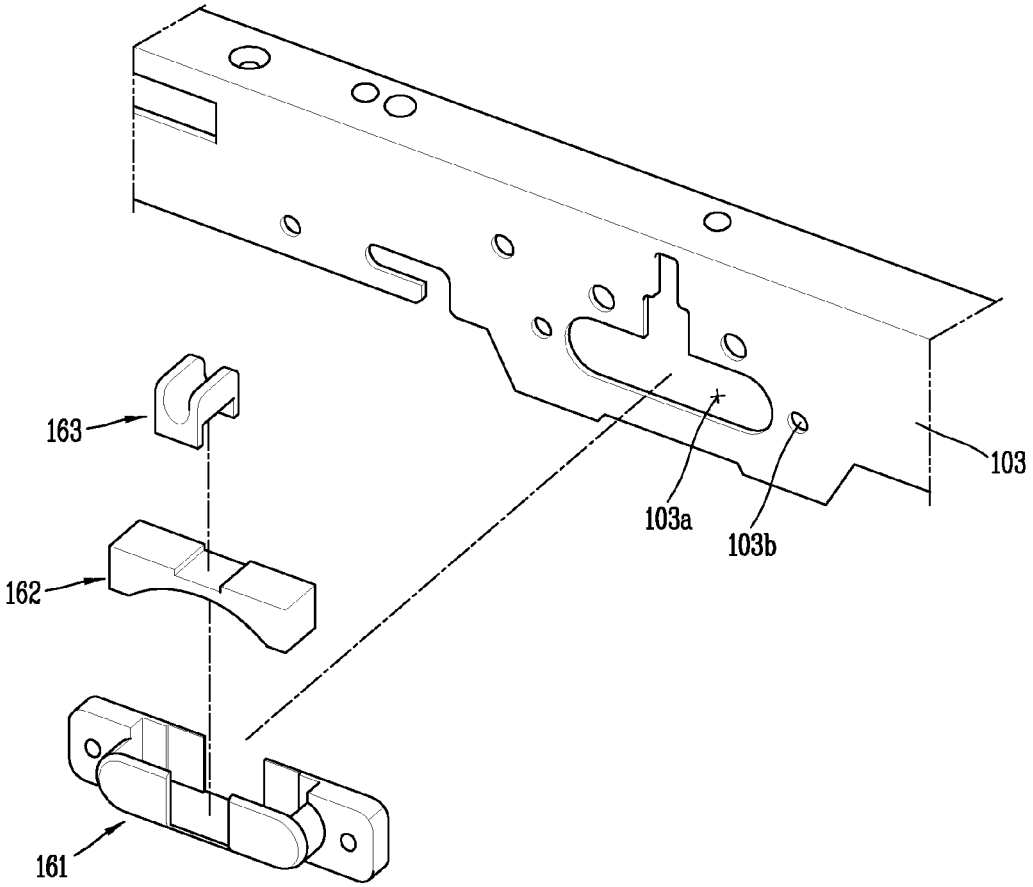
FIG. 10 is a disassembled perspective view of the weight sensing unit.
Figure 11:
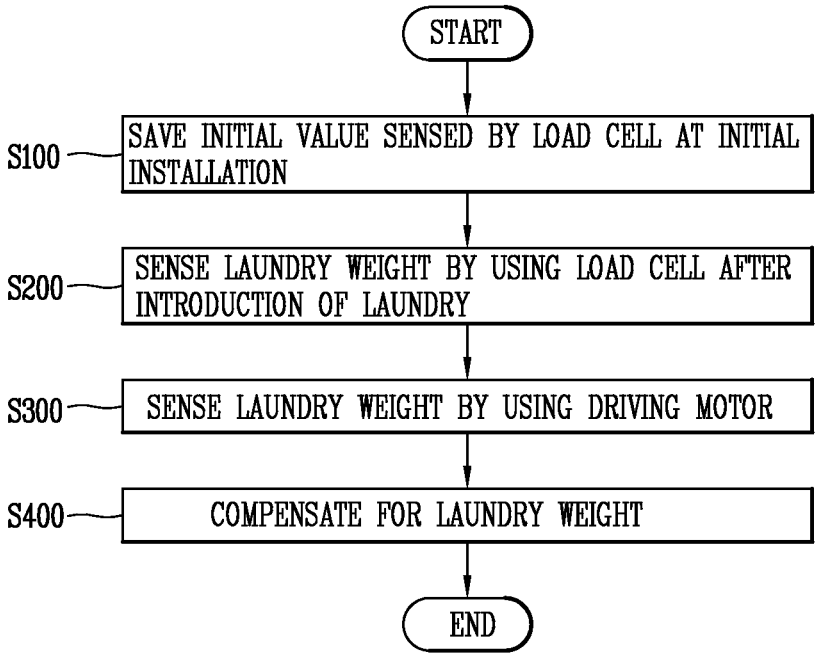
FIG. 11 is a flowchart showing a method for sensing a laundry weight in a washing machine in accordance with one exemplary embodiment.

In the meantime, in FIG. 7, the case 161 may further comprise coupling portions 161*c* each having a coupling hole 161*d* and coupled to the frame of the cabinet using a screw. FIG. 10 is a disassembled perspective view of the weight sensing unit. The frame 103 may include a coupling opening 103*a* for insertion of the weight sensing unit therein, and coupling holes 103*b* coupled by use of screws. After the load cell 162 and the pressure distributing member 163 are received in the case 161, the case 161 is inserted into the coupling opening 103*a* and screws may be inserted through the coupling holes 161*d* of the case 161 and the coupling holes 103*b* of the frame 103, thereby stably mounting the weight sensing unit onto the frame 103.

In the meantime, a method for sensing a laundry weight in a washing machine according to one exemplary embodiment may comprise saving an initial value sensed via a load cell at the moment of an initial installation of the washing machine (S100), sensing the laundry weight via the load cell after the laundry is introduced into the drum (S200), activating a driving motor for driving the drum and sensing the laundry weight by measuring a rotating speed of the driving motor via a sensor provided in the motor (S300), and compensating for the laundry weight sensed via the load cell to the laundry weight sensed by using the driving motor or the laundry weight sensed by using the driving motor to the laundry weight sensed via the load cell (S400).

The step of saving the initial value sensed via the load cell at the moment of the initial installation of the washing machine (S100) may refer to saving an initial measurement value via the load cell in a state that any laundry is not stored in the drum and the drum is not driven yet at the initial installation of the washing machine.

The reason why the initial value is saved is to prevent the situation that the load cell is able to correctly sense the laundry weight when a user puts the laundry into the drum after turning the washing machine on, but the washing machine is unable to sense the laundry weight when the user turns the washing machine on after putting the laundry into the drum. That is, even if the washing machine is turned on after the laundry is put into the drum, if the initial measurement value is already saved, the saved initial value may be compared with a measurement value obtained after turning the washing machine on, so as to calculate the weight of the laundry.

The step of sensing the laundry weight via the load cell after the laundry is put into the drum (S200) may refer to sensing the weight of the laundry within the drum via the load cell after the laundry is put into the drum.

The step of activating the driving motor for driving the drum and sensing the laundry weight by measuring the rotating speed of the driving motor via the sensor provided in the motor (S300) may refer to driving the driving motor, sensing a changed level of the rotating speed of the drum via the sensor provided in the driving motor, comparing the changed level of the rotating speed with the previously saved value, and determining the weight of the laundry.

The step of compensating for the laundry weight (S400) may refer to calculating the laundry weight by adding a preset weight to each of the laundry weight sensed via the load cell and the laundry weight sensed by using the driving motor. This is to precisely compensate for the laundry weight based on the value directly measured via the load cell with reference to the value inferred by using the driving motor. In other words, because an error may be generated in the value measured via the load cell due to the laundry being biased to a specific area within the drum, the laundry weight may be compensated for based on a laundry weight measured after driving the drum for a preset time. For example, a compensation method, in which A % of weight is given to the laundry weight measured via the load cell and (100−A) % of weight is given to the laundry weight inferred by using the driving motor and the laundry weights are added to each other, may be employed.

With the configuration, the weight sensing via the load cell for directly sensing the laundry weight within the drum and the weight sensing via the driving unit for indirectly sensing the laundry weight within the drum may be performed simultaneously, and a measurement value may be compensated for based on those values, allowing for more accurate sensing of the laundry weight.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A washing machine having a weight sensing unit comprising:

a cabinet forming an appearance;

a tub disposed within the cabinet;

a spring installed between the tub and a frame of the cabinet; and a weight sensing unit disposed on the frame of the cabinet, wherein the spring is hung on the weight sensing unit, wherein the weight sensing unit comprises:

a case coupled to the frame of the cabinet;

a load cell supported within the case; and a pressure distributing member mounted on the load cell, and holding the spring, wherein the pressure distributing member comprises a holding recess on which one end of the spring is held, and wherein the holding recess and the one end of the spring have a point contact therebetween.

2. The washing machine of claim 1, wherein the holding recess has a curved surface recessed to have a predetermined curvature, wherein the one end of the spring has a circular section with a predetermined curvature, and wherein the curvature of the curved surface of the holding recess is smaller than the curvature of the section of the one end of the spring.

3. The washing machine of claim 1, wherein the holding recess has a curved surface recessed to have a predetermined curvature, and wherein an extension line linking the lowest points of the curved surface has an arc shape.

4. The washing machine of claim 1, wherein the pressure distributing member further comprises a surface contact portion mounted onto the load cell to have a surface contact with the load cell.

5. The washing machine of claim 1, wherein at least one side of the load cell is arcuate and comprises a mounting portion formed on which the pressure distributing member is mounted, and wherein an arcuate peak of the load cell is under the mounting portion.

6. A washing machine having a weight sensing unit comprising:

a cabinet forming an appearance;

a tub disposed within the cabinet;

a spring installed between the tub and a frame of the cabinet; and a weight sensing unit disposed on the frame of the cabinet, wherein the spring is hung on the weight sensing unit, wherein the weight sensing unit comprises:

a case coupled to the frame of the cabinet;

a load cell supported within the case; and a pressure distributing member mounted on the load cell, and holding the spring, wherein the case comprises a receiving portion for receiving the load cell therein, and side walls forming side surfaces of the receiving portion, wherein the load cell is supported between the side walls with being received in the receiving portion, wherein an interval between the side walls changes along the load cell, and wherein an interval between the side walls at both ends of the load cell is narrower than an interval between the side walls at a central portion of the load cell.

7. The washing machine of claim 1, wherein the case further comprises coupling portions each having a coupling hole coupled to the frame of the cabinet by use of a screw.

* * * * *